United States Patent [19]

Elgass et al.

[11] Patent Number: 5,053,732

[45] Date of Patent: Oct. 1, 1991

[54] WAVEGUIDE SWITCHING SYSTEM COMPRISING A SINGLE STATOR AND A PLURALITY OF ROTATABLE WAVEGUIDE SWITCHES THEREIN

[75] Inventors: Manfred C. Elgass, Kings Park, N.Y.; Vincent A. Colucci, New Bern, N.C.

[73] Assignee: Logus Manufacturing Corp., Deer Park, N.Y.

[21] Appl. No.: 386,993

[22] Filed: Jul. 27, 1989

[51] Int. Cl.[5] ..... H01P 1/10

[52] U.S. Cl. ..... 333/106; 333/108; 333/258

[58] Field of Search ..... 333/101, 106, 108, 258, 333/262

[56] References Cited

U.S. PATENT DOCUMENTS 4,237,431 12/1980 Shisido et al. ..... 333/106

FOREIGN PATENT DOCUMENTS 262501 11/1987 Japan ..... 333/106

*Primary Examiner*—Eugene R. LaRoche
*Assistant Examiner*—Benny Lee
*Attorney, Agent, or Firm*—Bauer & Schaffer

[57] ABSTRACT

A waveguide switch assembly having a common stator in which a network of signal paths are provided inserted by rotors operated by individual motors responsive to a digital computer. An interface including a line receiver the input of which is coupled to the output of the computer. A one-shot multivibrator is coupled to and triggered by the line receiver. A relay driven by the one-shot controls application of current to the switch motor when the computer applies a differential input across the line receiver. A timer and a counter is used to prevent the switch motor from exceeding a defined duty cycle.

7 Claims, 3 Drawing Sheets

WAVEGUIDE SWITCHING SYSTEM COMPRISING A SINGLE STATOR AND A PLURALITY OF ROTATABLE WAVEGUIDE SWITCHES THEREIN

FIELD OF THE INVENTION

This invention relates to a waveguide switch system and more particularly to control circuit for the switch motors for a multiple waveguide, and also to a multiple waveguide switch assembly having a common stator housing.

BACKGROUND OF THE INVENTION

Waveguide switches are used in microwave systems to connect or disconnect one or more waveguide sections to other waveguide sections. These switches can be either manually or electromechanically operated.

Generally where two or more waveguide switches are required in a system, discrete switches are cascaded, as seen in FIG. 1, where four DPDT transfer waveguide switches 10*a*, 10*b*, 10*c* and 10*d* having discrete stator housings 1, 2, 3, and 4 are interconnected, in series by interposed flanges 11 and waveguide sections 12. This arrangement results in lowering of such RF parameters as VSWR and insertion power. In the electromechanically operated multiple switch waveguide, each switch is driven by a switch motor or actuator. An example of one such motor or actuator can be seen in U.S. Pat. No. 4,795,929. These motors are usually two position devices and have stringent duty cycle requirements. If the duty cycle is exceeded the motors overheat and can burn up. Implementing duty cycle protection in software for computer controlled systems is one means of protection, albeit one that can be overridden and subject to error. Further, irrespective of how duty cycle protection is implemented, the environment in which any motor control logic circuitry must work is demanding owing to the noise generated by operation of the switch motors and relays. This noise, including large inductive spikes, if not filtered or decoupled from the control logic circuitry will cause erratic operation and possibly failure of such logic.

It is an object of the present invention to provide an arrangement of a multiple array of waveguide switches having a common stator.

It is also an object of the present invention to provide a wave guide assembly in which a plurality of switches are housed in a common or monolithic assembly, thereby avoiding the excessive use of flanges and other connecting members.

It is a further object of the present invention to provide the means for independently driving each switch motor in a multiple array of same.

It is a still further object of the present invention to provide an interface control circuit between a digital computer and each switch motor of a multiple switch, common stator waveguide.

It is further object of the present invention to provide control circuitry to operate a multipole waveguide switch motor wherein the circuitry is hardwired so as not to exceed a defined duty cycle.

It is another object of the present invention to provide hardwired control circuitry for independently driving each switch motor of a multiple switch waveguide wherein the circuitry is immune to switching transients associated with the operation of the motors.

Other objects and features of the present invention will become apparent from the following disclosure.

SUMMARY OF THE INVENTION

According to the present invention a microwave system is provided whereby two or more waveguide switches are arranged in combination within a common stator thereby enabling a reduction in size and in RF loss.

The common stator housing of the present invention provides a single stator mass housing in which a plurality of multipole waveguide switches are fitted for simultaneous or independent operation. The common stator is provided with integral waveguides arrayed to communicate with the rotor bores in such a manner that selective signal paths can be obtained. This construction of the common stator housing, for the containment of multiple waveguide switch rotors, obviates the need for interposing flanges 11 and waveguide sections 12 as in the known station structure of FIG. 1. As a result, the common stator offers the advantages of increased packaging density, elimination of the deteriorative/deleterious effects of the interposed flanges and waveguide sections upon such RF parameters as insertion loss and VSWR, a corresponding reduction in parts and machining operations, and lower cost of manufacture per switch member.

DESCRIPTION OF THE DRAWINGS

In the drawings, wherein the same reference numeral denotes the same element throughout the several views.

DETAILED DESCRIPTION OF THE INVENTION

Figure 1:
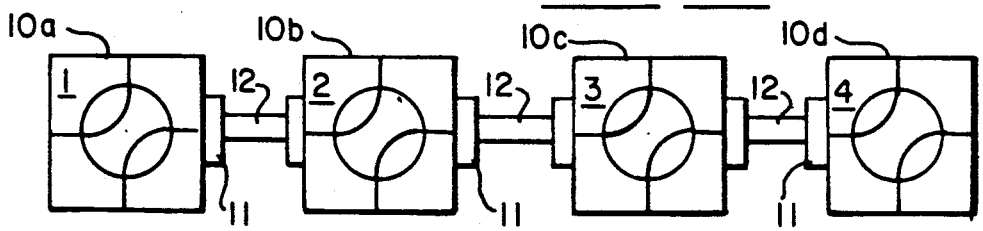
FIG. 1 PRIOR ART
FIG. 1 is a diagrammatic representation showing the prior art discrete coupling between a plurality of multipole waveguide switches.
Figure 2:
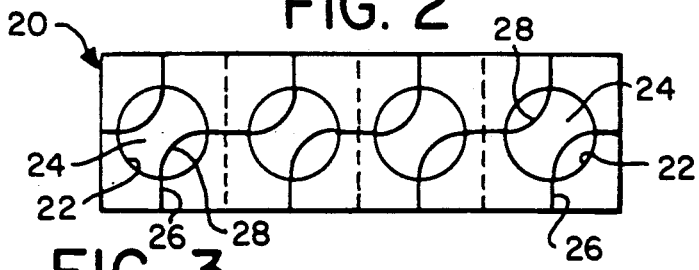
FIG. 2 is a diagrammatic representation showing a common stator waveguide switch in accordance with the present invention wherein four DPDT switches are employed in a linear array.
Figure 3:
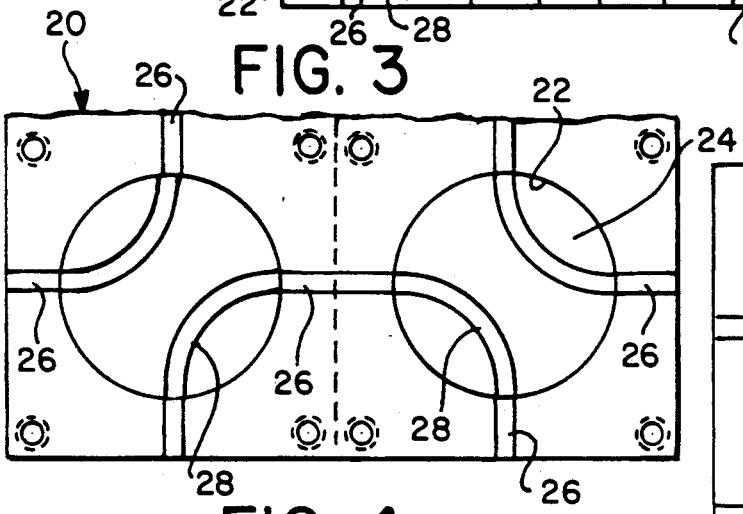
FIG. 3 is an enlarged representation of two adjacent waveguide switches in the array of FIG. 2.
Figure 4:
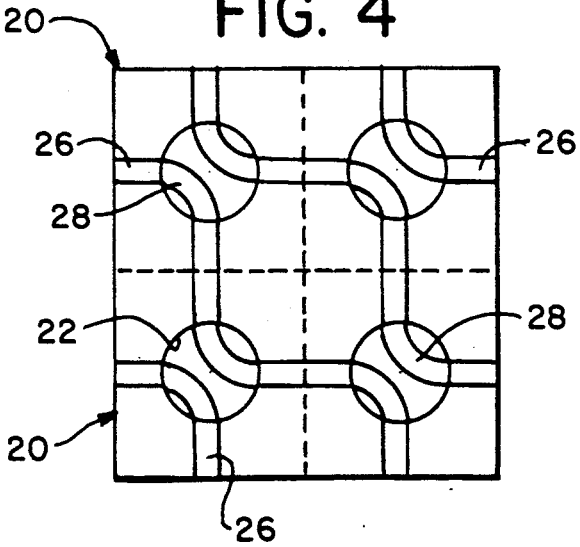
FIG. 4 is a diagrammatic representation of a common stator housing for four individual waveguide switches in a 2×2 matrix, with the drive motors omitted.

As seen in FIGS. 2 to 4, the inventive switch mechanisms dilineated by the dot dash lines each comprise a common stator housing 20 of parallelepiped shape having a plurality of spaced bores 22 the axes of which are parallel to each other. A respective rotor 24 is rotatably mounted in each bore. The stator can be formed of a single block or of several pieces to form a monolithic common housing for all the rotors. The stator 20 is formed with a plurality of waveguide inlet/outlet ports 26 arrayed in selected intersecting paths to pass signals serially into and out of the associated rotors. Preferably the inlet/outlet ports are arranged orthogonal to each other, i.e. at 90 degrees spacing about the circumference of the bore 22. Should more than four inlet/outlet ports be formed, they would be arranged in uniform spacing. The rotors 24 themselves are provided with curved waveguide section 28 arranged to align with selected pairs of the stator ports 26 in selected first and second positions. Position 1 is shown in the left hand switch of FIG. 3 while position 2 is shown at the right hand switch of FIG. 3. Preferably position 1 is the rest or normal condition, when the motor means is not actuated or is in the "off" condition. The switches may be formed as DPDT transfer switches, SPDT transfer switches or the like, as desired.

The rotors 24 are each driven by a switch motor 30 (see FIG. 6) of conventional design mounted on the end of the stator (see mounting holes). The motor has a pair of coils, selectively energized into the first or second position to rotate a motor to the rotor of which is coupled to switch rotor 24 (see for example aforementioned U.S. Pat. No. 4,795,929).

Figure 5:
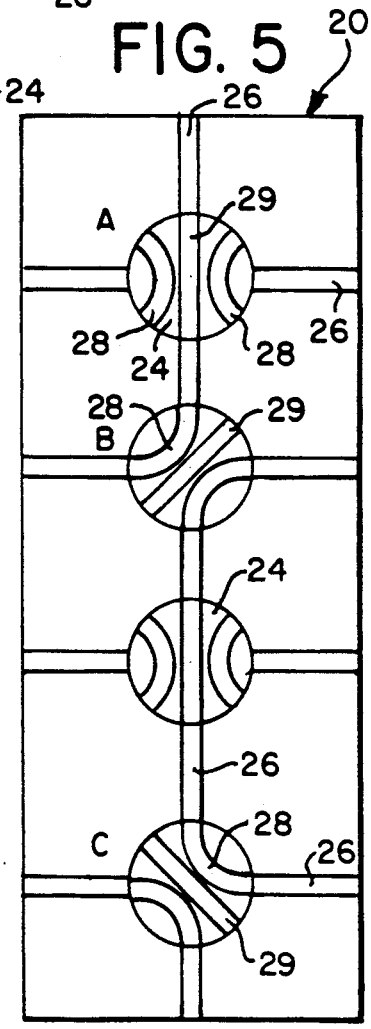
FIG. 5 is a diagrammatic receptacle of a common stator housing for four waveguide switches of single pole, triple throw.

In FIG. 5, an array of SP3T (single pole triple throw) switches are housed in common stator 20. The rotors 24 and the inlet/outlet ports 26 are otherwise formed as described above, except that each rotor is provided with a diametrical passage 29. By spring biasing the switch rotor 24 of this array, the diametric passage 29 is normally aligned with the longitudinal inlet/outlet ports 26. Three signal paths are possible in each rotor, even with a two position drive motor 30 referred to above. See for example, positions A, B and C in FIG. 5.

In FIG. 4, four switches are combined in a 2×2 matrix where each individual switch has its ports 26 and guides 28 arranged as previously described but interconnected in an intersecting array of signal paths. By selective positioning the rotor, a variety of paths for signal passage can be obtained from row to row and up and down the ranks.

This style of manufacture of the common stator housing allows for simpler and less expensive fabrication of stator housings when compared with the individual fabrication of discrete stator housings. Furthermore, this design greatly enhances the ability to compact several waveguide switches and obtain a denser package, through the elimination of the need for apparatus to connect individual ports from one waveguide switch to the next. By forming a monolithic stator waveguide, ports, as well as the bores, can be easily drilled at the same time. A further benefit of the configuration is the elimination of additional machining, casting, or other manufacture provisions for the mounting of the interconnecting apparatus.

The present invention also provides for a hardwired interface circuit between a computer and each one of the switch motors of the multiple switch common stator waveguide. With the inventive circuitry each motor can be operated independently. Because of the duty cycle limitations noted above, the inventive control circuit or interface includes logic that prevents a given motor from exceeding a predetermined amount of cycling or "on" time in a defined period. Since this predetermined duty cycle control is hardwired, it can not be changed easily. And, noise and switching transients are decoupled or filtered from the leads of the inventive apparatus.

In general the inventive interface apparatus is designed as seen in FIG. 6 around a quad differential line receiver comprising an integrated circuit that detects balanced and unbalanced digital transmission signals. The device converts these signals into digital logic levels, i.e. logic 0 and logic 1. In the embodiment shown, logic high or 1 is 5 VDC and logic low or 0 is 0 VDC or ground. These logic levels are then used to control various digital devices that are used to energize the waveguide switch motors which are provided with paired position coils. Each coil is adapted to drive the motor armature in opposing directions, thus creating an approximate 90 degree movement motor that can be driven in either of two directions. The motor 30 operates at 115 VAC, 60 to 400 Hz, and is able to turn on and off within that range upon command, to drive the switch to either the first position or the second position. The waveguide switches may overheat if both coils are allowed to be energized at the same time, or if switching is permitted at a rate of more than 6 cycles in six seconds. Therefore, the interface is arranged to detect a too rapid switching rate or simultaneous actuation of both coils, so as to provide a protective mode against excessive motor operation, thereby preventing internal damage to the switch motors.

It will be appreciated that the computer, (not shown), is provided and arranged with suitable hard program and software program for the appropriate control of the switch motors shown in FIGS. 2–5. The computer output is provided to interface as seen in FIG. 6 via a connector J1 and an interface input connector J3.

Figure 6A:
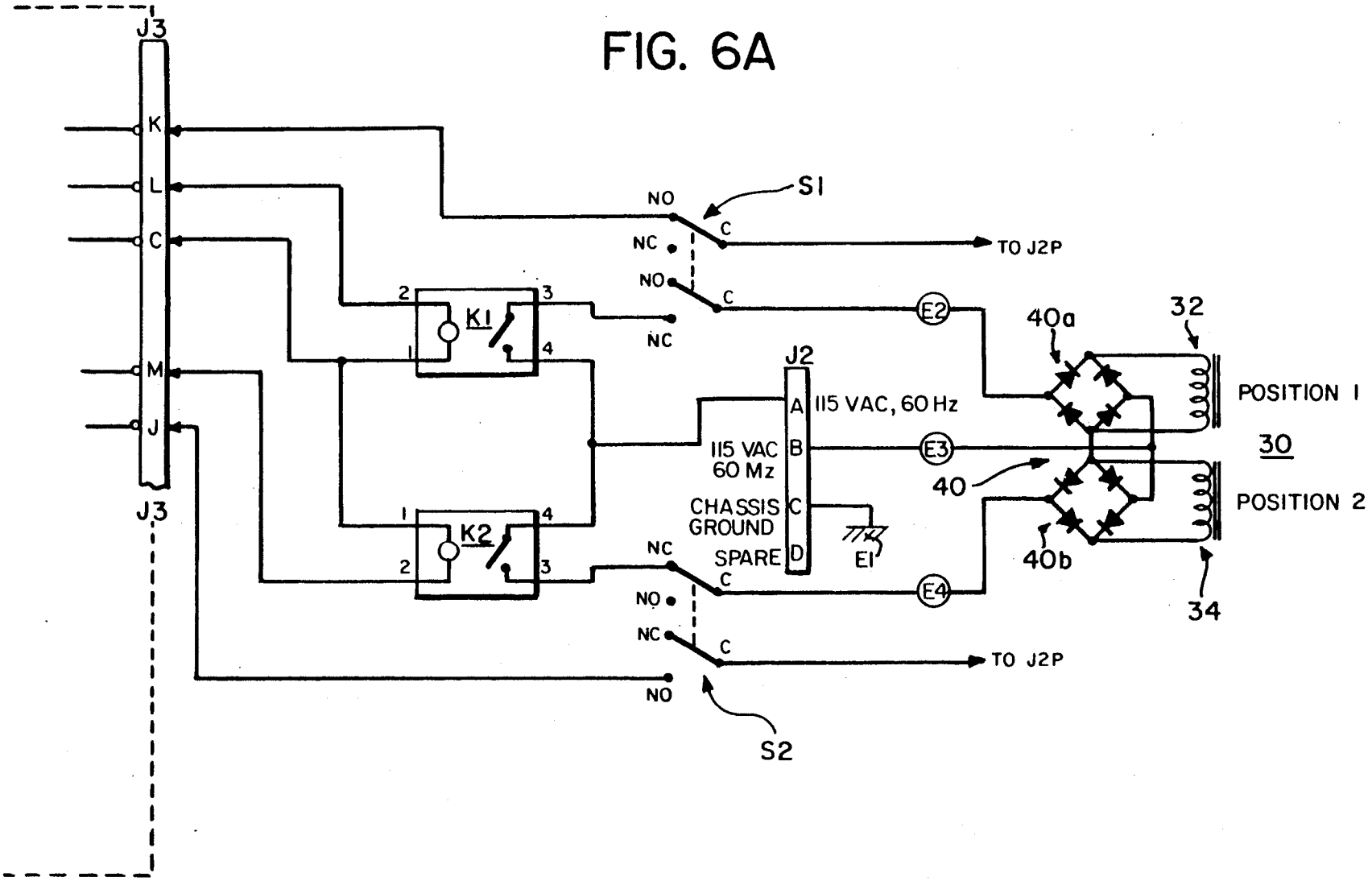
FIGS. 6A and 6B combined show the inventive interface circuitry for driving given switch motors in a multiple switch, common stator waveguide.
Figure 6B:
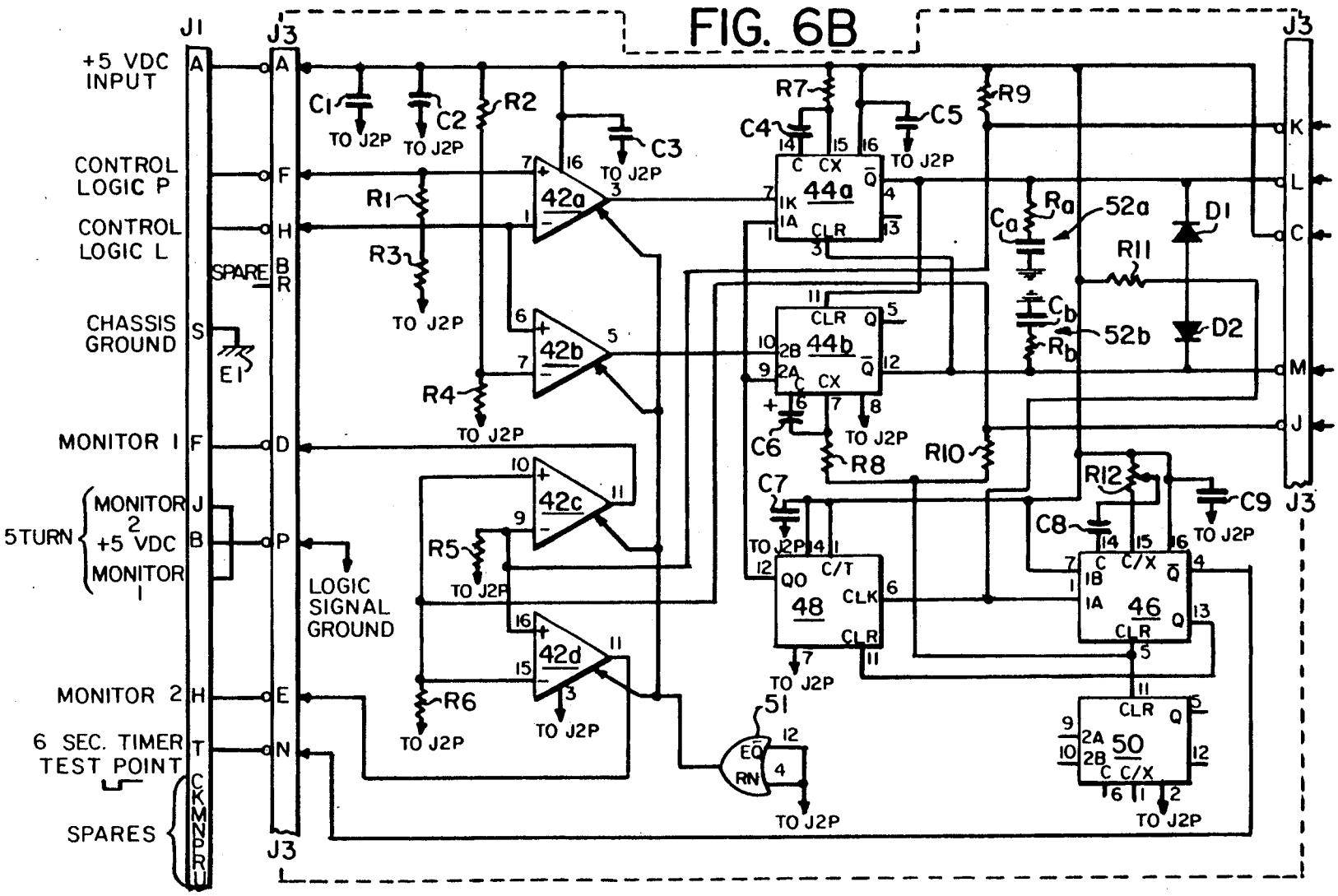

Referring specifically to FIGS. 6A and 6B, a representative switch motor 30 is shown which includes a position "1" drive coil 32 and a position "2" drive coil 34. A 115 VAC, 60–400 Hz. current is fed to each motor 30 through a device 40 comprising a diode bridge **40*a* and 40*b* associated respectively with each drive coil 32, 34 of each motor 30. The current flow is controlled by solid state relays K1 and K2 such as Teledyne part number 602-1. The relays K1 and K2 are each capable of switching 10 amps at 115 VAC, 60–400 Hz, and operate off/on TTL logic levels (0 and 5 VDC). Relays K1 and K2 are activated by tying their respective pins 1 to the line drive via pins C and A of connection J3 and J1 to provide either a constant source Vcc or +5 VDC and by changing their logic level at pin 2. By so doing, each relay can be turned on or off. This, in turn, energizes or de-energizes the required drive coil of switch motor 30**.

Interposed between the line drive and the relays K1 and K2 is an interface comprising in part a pair of line receiver IC's **42*a* and 42*b* actuated by a differential input voltage between their pins 1, 2 and 6, 7, as received from an external line drive via pins D and E of a J1 connector. When the differential voltage at 42*a* (pin 2) is greater than pin 1, line receiver 42*a* will change its logic level from low to high at its output pin 3. Likewise, when pin 6 of line receiver 42*b* is higher than pin 7, output at pin 5 of the receiver 42*b*** will go logic high.

The differential input or difference voltage is, in this case, approximately 4.5 VDC. The inputs of receivers **42*a* and 42*b* are wired such that the inputs D and E will only actuate 42*a* when input D is more positive than E. Likewise if E is more positive than D, only 42*b*** will actuate.

The output or logic levels of the line receivers **42*a* and 42*b* control respective output drivers 44*a* and 44*b* which in turn output one of the control associated relays K1 and K2. Output drivers 44*a* and 44*b* are ICs such as a Texas Instrument SN 54221 dual monostable multivibrator. The surrounding circuitry of these ICs set up 44*a* and 44*b* as a one-shot multivibrator, allowing each multivibrator or driver one-shot to turn on for a predetermined time. In this embodiment, each one-shot 44*a* and 44*b* is set for 300 ms. This applies power to a drive coil of 30 for 300 ms, hence the switch motor 30** actuates for less than 200 ms which insures that the motor will not turnoff prematurely. Operation of the switch motor is relatively fast. Hence the waveguide switch arrives in position long before the 300 ms envelope is completed.

The outputs of 42*a* and 42*b* trigger the respective one-shot inputs 41*a* (pin 2) and 44*b* (pin 10). When 44*a* is triggered, its output pin 4 changes from a logic high to a logic low. This places a logic low at pin 2 of relay K1 actuating the control circuitry thereof and applying power to position 1 drive coil of motor 30. Likewise, if 42*b* triggers the input of 44*b*, the output of 44*b* (pin 12) switches to logic low and activates relay K2. With relay K2 on, the switched contacts thereof apply power to drive position coil 2 of motor 30 energizing the waveguide switch to move into position 2. Note that the outputs of 44*a* and 44*b* are biased in high when not in use through Schottky diodes D1 and D2 and a 10 K ohm resistor, R11.

Another SN 54221 package containing two multivibrators comprises one part of the circuit portion which prevents excessive operation of the switch motor. One multivibrator constitutes a timer 46 whose timing factor is controlled by components set up around it so that it will have a time constant which is much longer than 44*a* or 44*b* and is adjustable through variable resistor R12. With the components shown, the timing can be varied from 3 to 10 seconds. Timer 46 is set for six seconds and its timed cycle begins when the first command is given to operate motor 30 and is clocked from the receipt of the logic level low by either diodes D1 or D2. The diodes D1 and D2 allow either the logic low of 44*a* or 44*b* to actuate the input of 46 at pin 1. As noted above and when the first command is given to operate motor 30, the timer 46 runs for about six seconds and shuts off. Pin T of connector J1 provides a monitor point for setting the time (adjusting R12) constant of the timer 46. Timer 46 is used to set and reset the second multivibration constituting a counter 48.

Counter 48 is a presettable decade binary counter such as Texas Instruments SN S-54176 and it comprises the other part of the circuit portion which, in combination with timer 46, prevents excessive operation of the switch motor 30. The counter 48 is a divide by 5 pulse counter, and as such, it accepts or counts 5 pulses at its clock input (pin 6) before changing state at its output or pin 12. The output of counter 48 controls the inhibiting of the drivers 44*a* and 44*b*, i.e. pin 12 of 48 is coupled to pin 1 of 44*a* and pin 9 of 44*b*. When counter 48, pin 6, counts five logic shifts from diodes D1 and D2, it changes state at pin 12 and inhibits 44*a* and 44*b*. Thus, after five counts, 44*a* and 44*b* cannot drive their respective relays K1 and K2 until the counter 48 is reset. The resetting of the counter 48 is accomplished by multivibrator 50 because the reset or clear line of the counter (pin 11) is coupled to the 'Q' output of the timer 46 (pin 13). The reset takes place only after the preset six seconds (associated with timer 46) have occurred at which point the output of 46 (pin 13) resets counter 48. Only at this time can the waveguide switch motor 30 be reactuated, starting the process over. A second multivibrator associated with the IC package of timer 46 is not utilized in this application and is not shown.

Turning back to the line receiver, two additional ICs 42*c* and 42*d* are utilized as monitor outputs. When the waveguide switch is in a given position, e.g. position 1, a microswitch S1, in the drive mechanism actuates IC 42*c* via gate 51. The logic output (pin 11) of 42*c* will then change state at J1 (pin F). This change in state at the last-mentioned pin will indicate that the waveguide switch is at position 1. Likewise, when the waveguide switch is switched to position 2, a microswitch, S2, signals, the IC 42*d* via gate 51 causing 42*d* output (pin 13) to change state which is communicated to J1 (pin H). Pin H of J1 is the monitor point for waveguide switch position 2. Microswitches S1 and S2 are also used to clear and reset drivers 44*a* and 44*b*. When the waveguide switch reaches either position 1 or 2, associated microswitches S1 and S2 reset respective drivers 44*a* (at pin 3) and 44*b* (pin 11).

It should be kept in mind that random noise or spikes can actuate any unused portions in the 44*a*–44*b* package. That is, when the computer signals operation of, say, the 42*a*–44*a* chain, the unused chain, 42*b*–44*b* might (owing to operation of reset microswitches S1 or S2) be in a floating condition. At this point any noise transient or stray induced electromotive signal (EMI) could randomly fire or startup the unused one-shot. If this occurs, the opposite or other drive coil of motor 30 will energize. This condition of driving the two coils simultaneously will cause the motor to overheat.

To prevent this condition, the circuit of FIGS. 6A and 6B inhibits the unused portion (chain) of the driver 44 one-shot package during the time the used portion (chain) of driver 44 is actuated during its 300 ms "on" time. This is accomplished by attaching pin 3 of driver 44*a* to the pin 12 output of driver 44*b* and connecting pin 11 of driver 44*b* to pin 4 of driver 44*a*. With this configuration and when actuating the first of the one-shots, e.g. driver 44*a*, the output of pin 4 will actuate the K1 relay. At the same time, that same output (pin 4 of driver 44*a*) will clear and inhibit drivers 44*b* at pin 11. The same will hold true if drivers 44*b* were actuated. The output of drivers 44*b* at pin 12 will actuate the K2 relay and clear drivers 44*a* at pin 2.

Not only can random noise cause unwanted simultaneous operation of the drive coils of 30, but such noise can cause misfiring of the motor 30. That is, if care is not taken in the design of the inventive apparatus, the waveguide switch, when activated, might only go for part of its travel and then stop. When either S1 and S2 open, arcing usually occurs across their contacts. This arcing generates noise and strong EMI which can be coupled back into the driving circuitry. When this noise randomly shows up on the output lines of drivers 44, it couples back to the input across the circuit board lands. This noise, if not filtered, will randomly and prematurely reset the drivers 44 device, shutting them off. Hence, as seen in FIGS. 6A and 6B, pins 4 and 12 of drivers 44*a* and 44*b* are filtered by the R-C combinations of Ra-Ca and Rb-Cb (52*a* and 52*b*), respectively. This filtering prevents misfiring of motor 30.

While only a limited number of embodiments of the present invention has been shown and described, it is to be understood that any changes and modifications can be made hereto without departing from the spirit and scope hereof.

What is claimed is:

1. A multiple multipole microwave switch assembly comprising a single stator having a plurality of bores formed therein, said bores being interconnected by a network of microwave signal inlet/outlet ports, a respective switch rotor located in each of said bores, each of said respective bores and said rotors constituting an individual switch within said assembly, having at least one microwave passage therein, electrical motor means coupled to each of said switch rotors for independently rotating said switch rotors between spaced first and second positions within the respective bores to selectively align said at least one microwave passage with a selected inlet/outlet port to effect the switching of microwave signals within said network, said inlet/outlet ports and the ends of each of said at least one passage in the rotor being disposed relative to the axis of said cylindrical bore so that the ends of said passage align with said inlet/outlet ports.

2. The waveguide switch assembly according to claim 1, wherein said at least one passage within each rotor is curved and has the ends thereof orthogonal to each other.

3. The waveguide switch assembly according to claim 1, wherein each said bore is cylindrical and the inlet/outlet ports are spaced from each other about the circumference of said bore by 90 degrees.

4. The waveguide switch assembly according to claim 3, wherein said cylindrical bores are arranged parallel to each other in said stator.

5. The waveguide switch assembly according to claim 3, wherein said stator comprises a monolithic parallelepiped.

6. The waveguide switch assembly according to claim 5, wherein said bores are arranged in a matrix configuration defined by said bores being disposed in a plurality of orthogonal rows in which the inlet/outlet ports between adjacent bores are integrally connected with each other.

7. The waveguide switch assembly according to claim 5, wherein said bores are arranged in a single row.

* * * * *